US007452116B2

(12) United States Patent
Natchoo

(10) Patent No.: US 7,452,116 B2
(45) Date of Patent: Nov. 18, 2008

(54) HEADLAMP DEVICE WITH MULTIFUNCTION ACTUATOR BLOCK FOR A MOTOR VEHICLE

(75) Inventor: Philippe Natchoo, Bobigny (FR)

(73) Assignee: Valeo Vision, Bobigny Cedex (FR)

( * ) Notice: Subject to any disclaimer, the term of this patent is extended or adjusted under 35 U.S.C. 154(b) by 98 days.

(21) Appl. No.: 11/114,845

(22) Filed: Apr. 26, 2005

(65) Prior Publication Data

US 2005/0237759 A1 Oct. 27, 2005

(30) Foreign Application Priority Data

Apr. 27, 2004 (FR) ..... 04 04473

(51) Int. Cl.
*F21V 19/02* (2006.01)

(52) U.S. Cl. ..... 362/523; 362/512; 362/466; 362/464; 362/465

(58) Field of Classification Search ..... 362/523, 362/512, 466, 464, 465
See application file for complete search history.

(56) References Cited

U.S. PATENT DOCUMENTS

| | | | | |
|---|---|---|---|---|
| 5,373,424 | A | 12/1994 | Ishikawa | |
| 5,806,956 | A | 9/1998 | Hyun-Jo | |
| 6,186,651 | B1 | 2/2001 | Sayers et al. | |
| 6,293,686 | B1 | 9/2001 | Hayami et al. | |
| 6,550,944 | B2 * | 4/2003 | Kusagaya | 362/466 |
| 6,568,837 | B2 * | 5/2003 | Denley | 362/463 |
| 6,637,918 | B2 * | 10/2003 | Changeur et al. | 362/487 |
| 6,960,006 | B2 * | 11/2005 | Abe | 362/538 |
| 7,090,385 | B2 * | 8/2006 | Sugimoto | 362/539 |
| 2001/0043474 | A1 | 11/2001 | Kusagaya | |
| 2004/0180578 | A1 * | 9/2004 | Duarte et al. | 439/608 |
| 2005/0141234 | A1 * | 6/2005 | Tajima et al. | 362/524 |

FOREIGN PATENT DOCUMENTS

| | | | |
|---|---|---|---|
| DE | 1020247381 | A1 | 4/2004 |
| EP | 1 139 011 | A1 | 10/2001 |
| EP | 1 197 387 | A1 | 4/2002 |
| EP | 1 234 716 | A1 | 8/2002 |
| EP | 1 270 321 | A2 | 1/2003 |
| FR | 2808750 | | 11/2001 |

OTHER PUBLICATIONS

Felten J-M: "L'Eclairage Directionnel" Revue Technique Automobile, ETAI, Boulogne,-Billancourt, FR vol. 57, No. 657, Jan. 2003, pp. 20-21, XP001144624 ISM:0017-307X.
French Search Report dated Nov. 23, 2004.

* cited by examiner

*Primary Examiner*—Stephen F. Husar
*Assistant Examiner*—Jessica L McMillan
(74) *Attorney, Agent, or Firm*—Morgan & Finnegan, LLP

(57) ABSTRACT

A lighting/signaling device for a motor vehicle having a source arranged in a reflector which produces a light beam that is transmitted from the reflector along an essentially horizontal optical axis of the headlamp device. A movable flap is coupled to a first motor pivoting the movable flap between at least two positions. A casing which coupled to a second motor can be rotated, with respect to a fixed frame, along an axis which is essentially vertical and essentially perpendicular to the optical axis. The casing also includes at least one compartment for receiving and holding the first motor and the second motor.

15 Claims, 2 Drawing Sheets

HEADLAMP DEVICE WITH MULTIFUNCTION ACTUATOR BLOCK FOR A MOTOR VEHICLE

FIELD OF THE INVENTION

The present invention relates to a headlamp device comprising a multifunction actuator block. The term actuator is understood to mean an electrical engineering element, of the motor type, which is associated with a kinematic chain allowing movement of a target element. Usually, an actuator comprises an electronic control card designed to manage operation thereof. The actuator block present in the headlamp device according to the invention is a multifunction actuator block: it makes it possible to implement a first function consisting in tilting a pivoting flap within the headlamp device, and a second function which is known as the DBL function. One essential object of the invention is to be able to implement these two functions, within one and the same headlamp device, while taking up as little volume as possible and without any mutual disruption between the various elements involved in the kinematics of these two functions.

BACKGROUND OF THE INVENTION

The field of the invention is, in general, that of motor vehicle headlamps. In this field, various types of headlamp devices are known, essentially including:

- sidelights, having a low intensity and range;
- dipped beam headlights, having a greater intensity and a range of around 70 metres, which are used essentially at night and the distribution of the light beam of which is such that it does not dazzle the driver of an oncoming vehicle;
- full beam headlights having a long range and additional headlights having a long range, which make it possible to see the road over a distance of around 200 metres and which have to be turned off when passing another vehicle so as not to dazzle the driver thereof;
- foglights.

Moreover, an improved type of headlamp is known, referred to as a dual function headlamp, which combines the functions of dipped beam headlights and full beam headlights; to this end, it is possible for example to place inside the dual function headlamp a removable mask which can pass on command from a first position in which it blocks off part of the light signal produced by the light source of the headlamp, the range of the headlamp thus being limited to that of dipped beam headlights so as not to dazzle other drivers, to a second position in which it does not block off the light signal produced by the light source of the headlamp, the range of the headlamp then corresponding to that of full beam headlights, as described in the patent EP 1 197 387. This example of embodiment is mainly implemented in headlamp devices of the elliptical type. Based on the same principle, there are also multifunction headlamps in which a removable mask can adopt more than two positions so as to selectively block off in a number of ways the light beam transmitted by the source; it is thus possible to have dual function masks of the type "dipped headlights traffic to the right/dipped headlights traffic to the left" and triple function masks of the type "dipped headlights traffic to the right/dipped headlights traffic to the left/full beam headlights", etc.

One particular type of headlamp is also known which makes it possible, particularly at night, to obtain a visible image of the road on a control screen. This type of headlamp is in fact a headlamp of the full beam type, equipped with a tilting infrared filter which can pass on command from a first position in which it filters out all of the light signals produced by the light source of the headlamp, so that only the non-dazzling infrared rays effectively pass out from the headlamp device, to a second position in which the filter does not block off any light signal produced by the light source of the headlamp, the range of the headlamp then corresponding to that of full beam headlights. Reference may be made, for example, to patent EP 1 139 011.

Within the context of the invention, the removable mask and the infrared filter are two particular examples of a pivoting flap involved in the first function of the headlamp device according to the invention.

Moreover, in addition to the conventional main headlamp functions which have just been mentioned, in particular dipped beam and full beam, various improvements are also known which have gradually appeared. Elaborate or advanced functions have thus been developed, including in particular a function known as DBL (Dynamic Bending Light). The DBL function makes it possible to modify the orientation of a light beam produced by a light source, such that, as the vehicle approaches a bend, the road is lit up in an optimal manner.

In general, the headlamp devices dealt with by the invention are all those which are:

- able to be equipped with a flap which can move, in particular by pivoting, independently of the function fulfilled by said movable flap, capable of tilting and moving, on command and by virtue of the presence of a motor, between a first position, known as the active position, in which the light signals transmitted by a light source of the headlamp device equipped with said flap strike the pivoting flap and a second position, known as the passive position, in which the light signals do not strike the pivoting flap;
- able to implement the DBL function.

There are not known, in the prior art, any headlamp devices which combine these two functions. Moreover, the production of a headlamp device which would juxtapose, as exist in the prior art, an actuator which makes it possible to implement the first function and an actuator which makes it possible to implement the second function would not give a satisfactory solution. This is because the first actuator comprises a first motor which, in the prior art, is arranged in a first casing on a front part of the headlamp device and which would disrupt the movement brought about by the actuator associated with the second function, this second actuator being arranged in a second casing on a rear part of the headlamp device. The presence of these two separate casings would moreover be penalizing in terms of size.

It is an object of the invention to overcome all the drawbacks which have just been mentioned. To this end, in the invention, there is proposed a headlamp device which has a single multifunction actuator block in which various elements are grouped together, in particular a first motor and/or a second motor, which make it possible to implement a function of tilting a pivoting flap and a DBL function. The multifunction actuator block is integrated in a casing which can move about an axis of rotation which allows the movement corresponding to the DBL function of the headlamp device. All of the elements involved in the actuators associated with these two functions are attached to the movable casing, so that the elements of the two actuators follow the rotational movement generated by the DBL function, thus providing the possibility of implementing the first function regardless of the orientation of the headlamp device which is imposed by the second function.

SUMMARY OF THE INVENTION

The invention therefore essentially relates to a headlamp device comprising in particular:

- a light source arranged in a reflector which produces a light beam which is transmitted, at an outlet face of the reflector, in particular along an essentially horizontal optical axis of the headlamp device;
- a movable, in particular pivotable, flap which by means of a first motor can be moved between at least two positions, for example between a passive position in which it does not intercept the light beam and an active position in which it intercepts at least part of the light beam;

such that the headlamp device comprises a casing which by means of a second motor can be moved, in particular can be moved in rotation, with respect to a fixed frame of said headlamp device, along an axis which is essentially vertical and/or essentially perpendicular to the optical axis, said casing comprising at least one compartment for receiving and holding on the one hand the first motor and on the other hand the second motor which brings about the movement of the casing.

The movable flap may move by a pivoting movement with respect to an axis or else by a rotation or translation movement.

The headlamp device according to the invention may also have, besides the features mentioned in the previous paragraph, one or more of the following secondary features:

- the first motor is a DC motor;
- the second motor is a stepping motor;
- the casing which can be moved in rotation comprises at least two holding elements for positioning and holding a rod which forms a support for the pivoting flap;
- the casing which can be moved in rotation comprises a central opening designed to be passed through by a part of the reflector which forms the bottom of the reflector;
- the casing which can be moved in rotation comprises at least one holding stub designed to cooperate with at least one opening made in a surface of the reflector which defines the outlet face, so as to hold the reflector in an assembled position;
- the headlamp device comprises a photometric plate secured to the movable casing;
- the fixed frame has a toothed sector which cooperates with a first pinion driven in rotation by the second motor so as to bring about the movement of the movable casing;
- the second motor drives a worm in rotation so as to cause the first pinion to rotate;
- the movable casing comprises an additional compartment for receiving electronic means, of the single electronic control card type, for managing the operation of the first motor and/or of the second motor;
- the additional compartment is arranged in a side part of the movable casing.

Another object of the invention is a motor vehicle equipped with a headlamp device comprising the features mentioned above.

The invention and its various applications will be better understood from reading the following description and with reference to the accompanying figures. These are given solely by way of example and in a manner which in no way limits the invention.

Elements which appear in different figures keep the same references.

DESCRIPTION OF THE PREFERRED EMBODIMENTS

Figure 1:
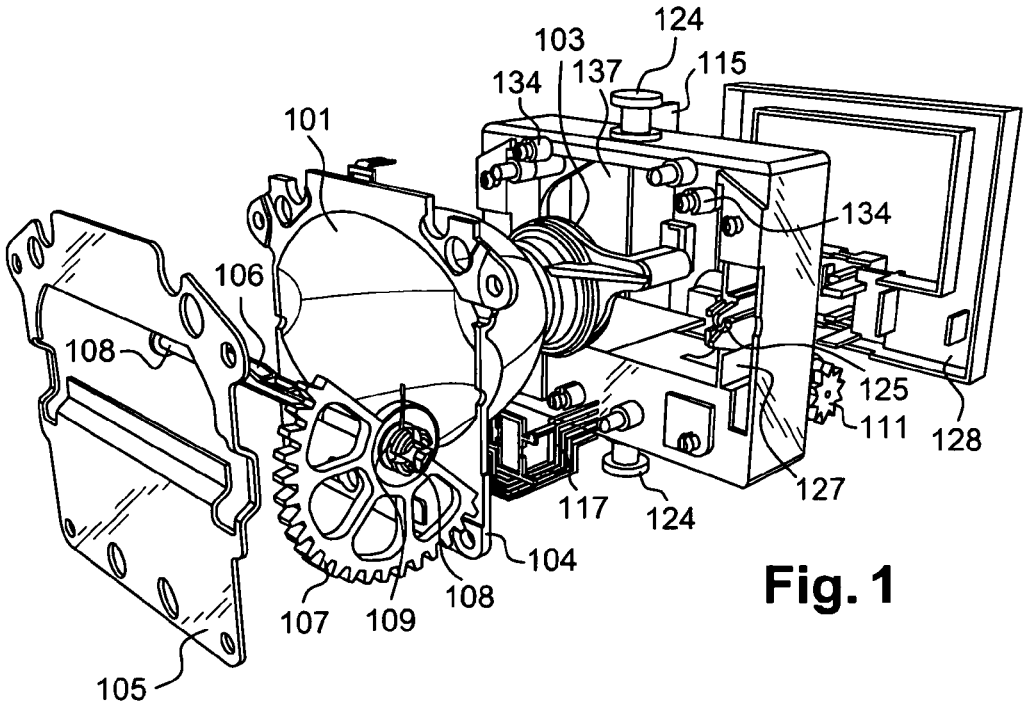
FIG. 1 shows a first exploded view of an example of embodiment of a headlamp device according to the invention.
Figure 2:
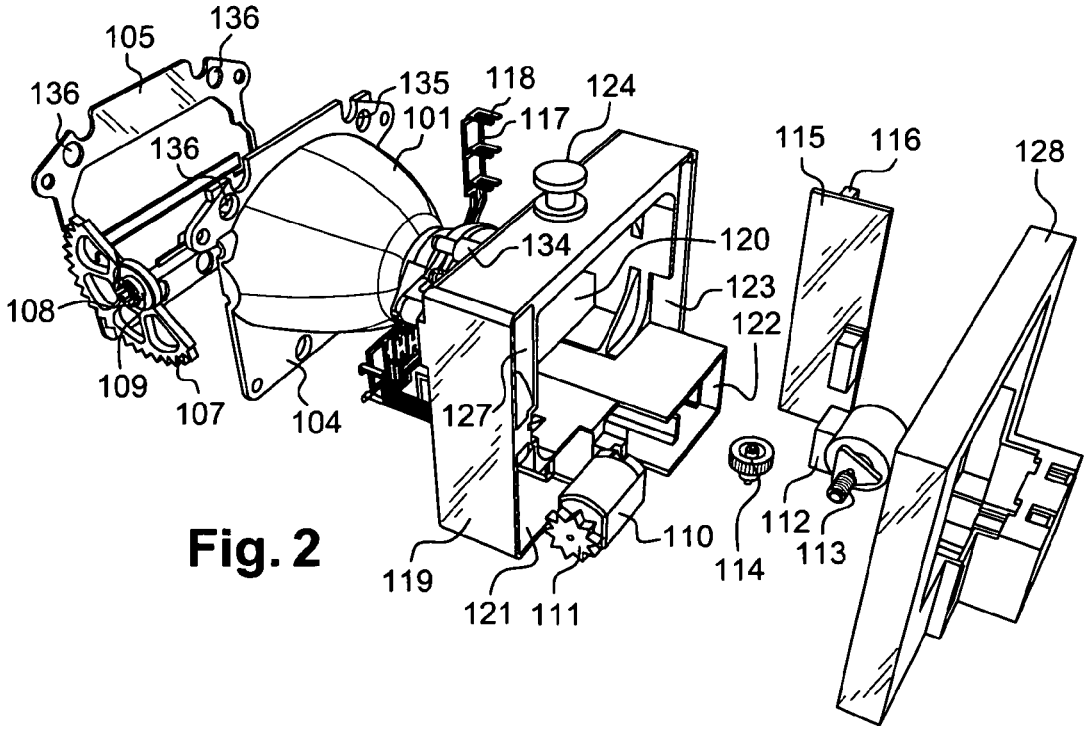
FIG. 2 shows a second exploded view of an example of embodiment of the headlamp device according to the invention.
Figure 4:
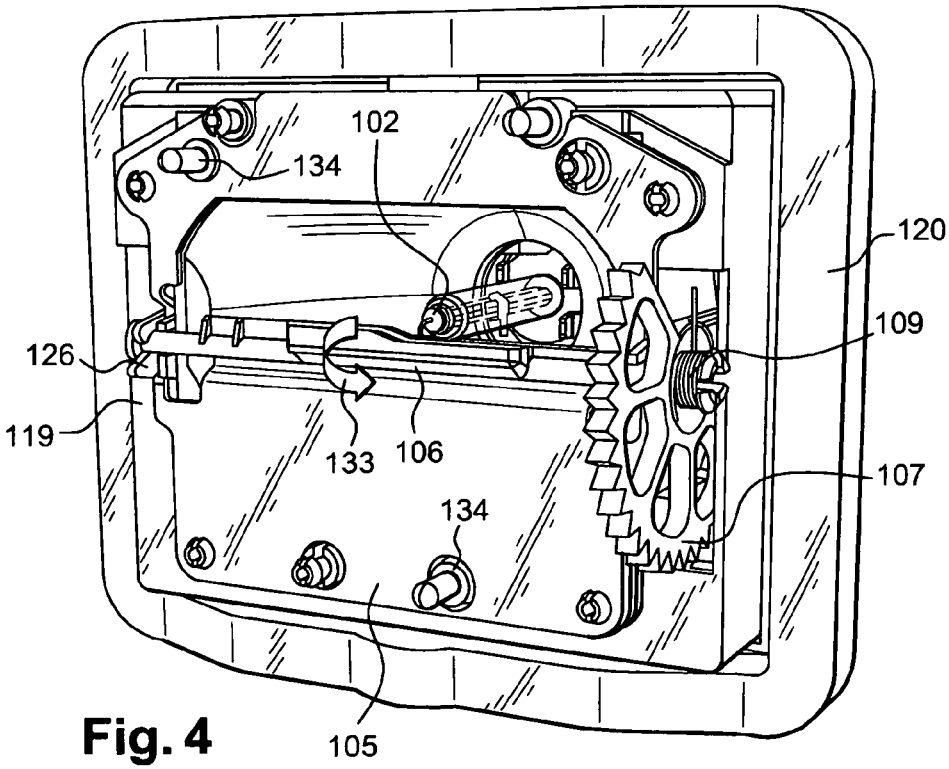
FIG. 4 shows a second assembled view of the headlamp device according to the invention.

FIGS. 1 and 2 show the various main elements designed to be integrated in a headlamp device according to the invention. The following elements in particular can be seen:

- a reflector 101, within which there will be placed a light source 102, visible only in FIG. 4, held by a bulb-carrying element 103, for producing a light beam corresponding to the use made of the headlamp device. Defined for the reflector 101 is an outlet face which is a surface perpendicular to the optical axis of the headlamp device and is shown by an edge 104. The light beam produced is directed along an essentially horizontal optical axis and directed towards the front of the vehicle so as to light up in an optimal manner the road taken. The term essentially horizontal optical axis is understood to mean the fact that the optical axis, which corresponds to a direction of maximum intensity with which light is transmitted by the headlamp device in question, is contained in a plane parallel to the road, give or take one or two degrees.
- a photometric plate 105, designed to be arranged such that it bears against the edge 104. The role of the photometric plate 105 is to close off various cavities which would allow photometric leaks to escape out of the headlamp device, said photometric leaks not being designed to contribute to the production of the expected light beam. The shape of the photometric plate is such that it does not intercept the light rays needed to produce the expected light beam, whether this be a light beam of the full beam or dipped beam type. Moreover, it plays a heat protection role, in particular protecting the electronic components and motors from the heat given off by the light beam.
- a pivoting flap 106 which is designed to fulfil the first function described above. In the example shown, the pivoting flap is of the removable mask type, that is to say that it has a shape which makes it possible to obtain, by projection, either a standard dipped beam when it is in an active position in which it intercepts part of the light beam produced by the light source 102, or a standard full beam when it is in a passive position in which it does not intercept the light beam produced by the light source 102; the shape of the pivoting flap which makes it possible to obtain a standard cut-off line for the dipped beam headlights is formed in a rod which has, at one of its ends, a toothed wheel 107 and two circular end pieces 108 located at each end of the rod. A return spring 109 is arranged on one of the ends of the rod; it makes it possible instantaneously to bring about the tilting of the pivoting flap in a direction opposite to that given by a motor. In other examples of embodiments of the headlamp device according to the invention, the pivoting flap may be of the infrared filter or multifunction type.
- a first motor 110 designed to actuate the pivoting flap. Preferably, for reasons of size (or other reasons, particular electronic control), use is made of a DC motor. The first motor essentially consists of a motor block which drives in rotation a motor rod which bears a first pinion 111.

a second motor 112 designed to bring about the movement of the headlamp device so as to fulfil the DBL function. For reasons of precision of the movements brought about by this motor, use is preferably made of a motor of the stepping motor type. The second motor 112 essentially consists of a motor block which drives in rotation a motor rod which bears, in the example shown, a worm 113. The worm makes it possible to drive in rotation a second pinion 114, the role of which will be described in more detail below.

an electronic control card 115 designed to manage the operation of at least one of the two motors 110 and 112. In one preferred embodiment of the headlamp device according to the invention, the electronic card 115 manages the operation of the first motor 110 and of the second motor 112. In this way, a not insignificant gain in terms of space is obtained in the embodiment of the headlamp device. The electronic card 115 may be equipped with a sensor of the Hall effect type 116 which makes it possible for it to know precisely, at each instant, an angle of rotation, with respect to a reference angle, of the headlamp device associated with the implementation of the DBL function.

a metal conduction piece 117 bearing a set of connection tabs 118 which are designed to enter into contact with various tracks of the electronic card 115, essentially so as to supply power to the card and to supply electrical power to the first motor 110 and the second motor 112. In one particular method of manufacturing the headlamp device according to the invention, prior to pouring in the liquefied plastics material, the metal piece 117 bearing the various connection tabs 118 is placed in a mould designed to manufacture the movable casing 119, and then, once the monoblock article has been removed from the mould, the various connection tabs are sectioned off so that they are not mutually conductive. Such a manufacturing method makes it possible to omit a successive disposition of the connection tabs, which is difficult to carry out.

a casing 119 which can be moved in rotation with respect to a fixed frame 120 (visible in FIGS. 3 and 4) of the headlamp device, along an axis which is essentially vertical and perpendicular to the optical axis. The term fixed frame of the headlamp device is understood to mean a part which is not able to enter into movement within the headlamp device. The term essentially vertical axis is understood to mean an axis which is perpendicular to a plane defined by a road on which the motor vehicle comprising the headlamp device according to the invention is travelling, give or take one or two degrees. The movable casing 119 essentially consists of a frame having a central opening 137 so as to be passed through by the reflector 101 upon assembly of the various elements which make up the headlamp device.

The movable casing 119 also has, formed in the thickness thereof, a set of compartments for receiving and/or holding the various elements which have just been mentioned. There can thus be seen, in the example shown, a first compartment 121 for receiving and holding the first motor 110; a second compartment 122 for receiving and holding the second motor 112; a third compartment 123 for receiving and holding the electronic card 115. In the example of embodiment shown, the third compartment 123 is formed in a side part of the frame which forms the casing 119 which can be moved in rotation. Such an arrangement, at the side of the headlamp device, makes it possible to keep the electronic card 115 as far away as possible from the zones of greatest heat of the headlamp device. The relative position of the first motor 110, the second motor 112 and the electronic control card 115 requires that the metal conduction piece 117 has a right-angled shape, as shown in FIGS. 1 and 2, so as to provide the connection between these various elements.

The movable casing 119 also comprises two circular protuberances 124 located in a central part of an upper face and lower face of its frame, which protuberances are designed to be held in cavities provided for this purpose on the fixed frame 120 of the headlamp device according to the invention, so as to allow the movement in rotation of the DBL function.

The movable casing 119 finally comprises at least a first holding element 125 and a second holding element 126 (visible in FIG. 4) which make it possible to receive the ends 108 of the rod which forms a support for the pivoting flap 106; once the pivoting flap 106 is held by the holding elements 125 and 126, it can move in rotation about an axis of rotation, referred to as the axis of rotation of the pivoting flap, said axis being defined by a straight line passing through the centre of the two holding elements, said straight line being roughly represented by the rod. A clearance 127 is provided in the structure of the movable casing 119 so as to allow the toothed wheel 107 to rotate.

a cover 128 designed in particular to close the various compartments which have just been described, so as to ensure sealing of these compartments.

Figure 3:
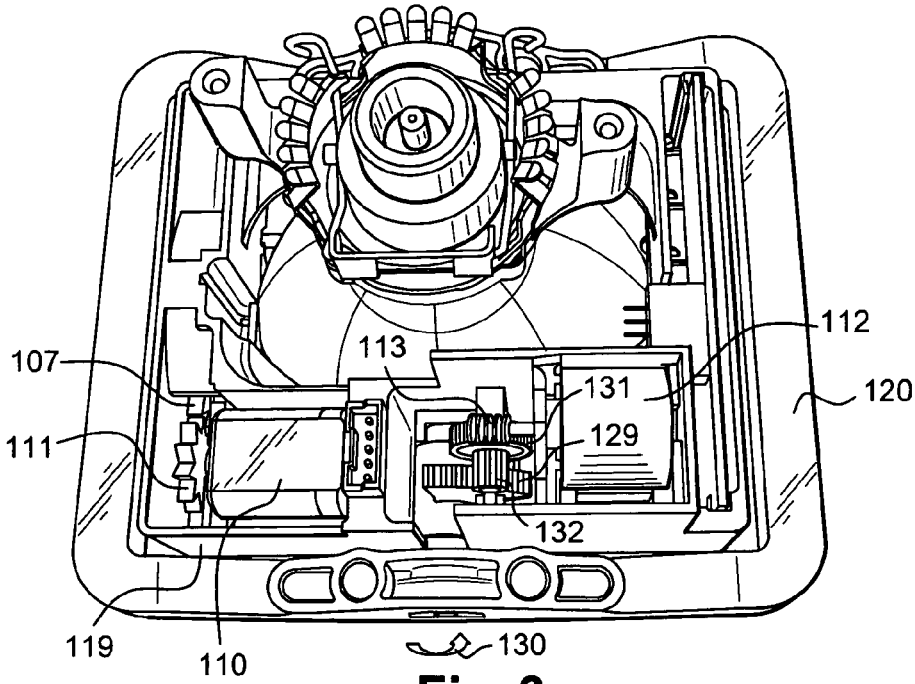
FIG. 3 shows a first assembled view of the headlamp device according to the invention.

FIGS. 3 and 4 demonstrate, by showing different views of the headlamp device according to the invention in the assembled state, the interactions between the various elements involved in the actuators which make it possible to implement the first function and the second function.

In order to implement the DBL function, use is essentially made of a fixed toothed sector 129 which remains immobile with respect to the fixed frame 120, for example by being directly fixed to the fixed frame 120. The fixed toothed sector 129 collaborates with the second pinion 114 in order to drive the movable casing 119 in rotation about an axis of rotation formed by the two circular protuberances 124, said rotation being shown in FIG. 3 by a first arrow 130. To this end, the fixed toothed sector is at least partially circular. Thus, when the second motor 112 is active, it drives the worm 113 in rotation, which worm itself drives in rotation the second pinion 114 which moves along the fixed toothed sector 129, thus causing the movement of the movable casing 119.

In the example shown, the second pinion 114 consists of a first stage 131 and a second stage 132, the first stage and the second stage corresponding respectively to a first toothed wheel and to a second toothed wheel, the two toothed wheels being coaxial and having different diameters. Such a structure makes it possible to maintain a reduction ratio between the rotational speed imposed by the motor and an angular velocity which the headlamp device must maintain as it moves in rotation so as to implement the DBL function. Moreover, with regard to the range of angles to be covered by the movable headlamp device within the context of the DBL function, it is sufficient for the fixed toothed sector 129 to be limited to a quarter of a circle.

In order to implement the first function, namely the tilting of the pivoting flap 106, the first motor 110 is activated and, via a motor rod which cannot be seen in the figures, drives in rotation the first pinion 111 which has been engaged beforehand in the toothed wheel 107, at the time of assembly of the various elements which make up the headlamp device. Since the toothed wheel 107 is secured to the pivoting flap 106, it drives the latter in rotation about an axis of rotation formed by the two circular end pieces 108, said rotation being shown in FIG. 4 by a second arrow 133.

The two actuators which make it possible to implement the first function and the second function thus form a single actuator block: the first motor 110 and the second motor 112, and also the various elements involved in the kinematic chains which allow the movement of the target elements (the pivoting flap 106 or the casing 119 which can be moved in rotation), are held on or attached to different compartments of one and the same element, the movable casing 119. The latter, in the example shown, thus comprises, besides the various compartments and holding elements mentioned above, at least one holding stub 134, each holding stub 134 being designed to be introduced into a circular opening 135 of the reflector 101 and a circular opening 136 of the photometric plate 105 so as to hold these two elements.

Thus, by virtue of the headlamp device according to the invention, the number of parts involved in the implementation of the two functions is reduced: on account of the integration of the various elements of the two actuators in—or on—the casing 119 which can be moved in rotation, use is not made of a specific casing for each actuator; in this way, the difficulties in terms of assembly of the headlamp device and the above-mentioned risks of mutual disruption of the two functions are reduced. Moreover, the headlamp device proposed in the invention forms a standard which can fulfil either the first function or the second function or both functions: all that is required, in the first case and the second case, is to remove the actuator which will not be used and to adapt the electronic means, in this case the electronic card 115, as a consequence. The headlamp device according to the invention may be used both as a left-hand headlamp and as a right-hand headlamp of a vehicle.

What is claimed is:

1. A lighting/signaling device for a motor vehicle headlamp comprising:

a frame;

a movable casing rotatably mounted in said frame and having at least one compartment for receiving and holding a first motor and a second motor;

a reflector for receiving a light source for producing light to be transmitted toward and through an outlet face of said reflector along a substantially horizontal optical axis, said reflector being mounted to said movable casing along an edge portion of said outlet face;

a movable flap pivotally attached to said movable casing for movement between an active position in which said movable flap intercepts a portion of light transmitted through said outlet face of said reflector and an inactive position in which said flap does not intercept light transmitted through said outlet face of the reflector;

a first motor mounted in said at least one compartment of said movable casing, said first motor being coupled to said movable flap for pivoting said movable flap between said active position and said inactive position;

a second motor mounted in said at least one compartment of said movable casing, said second motor being coupled to said fixed frame; for rotating said movable casing relative to said fixed frame along an axis substantially perpendicular to said optical axis; and a photometric plate mounted to said movable casing and bearing against said edge portion of said outlet face of said reflector.

2. The lighting/signaling device according to claim 1, wherein said first motor is a DC motor.

3. The lighting/signaling device according to claim 1, wherein said second motor is a stepping motor.

4. The lighting/signaling device according to claim 1, wherein said movable casing comprises at least two holding elements for positioning and holding a rod for supporting the movable flap.

5. The lighting/signaling device according to claim 1, wherein said movable casing comprises a central opening through which a part of said reflector extends.

6. The lighting/signaling device according to claim 1, wherein said movable casing comprises at least one holding stub that cooperates with at least one opening through said edge portion of said reflector for mounting said to said movable casing.

7. The lighting/signaling device according to claim 1, wherein said second motor and said fixed frame are coupled by way of a toothed sector fixedly mounted to said fixed frame which cooperates with a pinion to be driven in rotation by said second motor so as to bring about rotation of said movable casing.

8. The lighting/signaling device according to claim 7, wherein said second motor drives a worm in rotation that is interposed between said second motor and said pinion so as to cause the first pinion to rotate.

9. The lighting/signaling device according to claim 1, wherein said movable casing comprises an additional compartment for receiving an electronic means for managing operation of said first motor or said second motor.

10. The lighting/signaling device according to claim 9, wherein said additional compartment is arranged in a side part of said movable casing.

11. The lighting/signaling device according to claim 9, wherein said electronic means comprises an electronic control card.

12. A motor vehicle equipped with a lighting/signaling device according to claim 1.

13. A lighting/signaling device for a motor vehicle headlamp comprising:

a frame;

a movable casing comprising a central opening and at least one compartment having a first motor and a second motor mounted therein, said movable casing being rotatably mounted in said frame;

a reflector for receiving a light source and for producing a light beam to be transmitted along a substantially horizontal optical axis toward and through an outlet face of the reflector, said reflector extending through said central opening of said movable casing, an edge portion of said outlet face of said reflector being mounted to said movable casing; and a movable flap coupled to said first motor for moving said movable flap between at least a passive position, in which said movable flap will not intercept any portion of the light beam, and an active position, in which said movable flap will intercept at least a part of the light beam;

said second motor being coupled to said fixed frame for rotating said casing with respect to said fixed frame along a vertical axis substantially perpendicular to said substantially horizontal optical axis.

14. The lighting/signaling device of according to claim 13, wherein said first motor is mounted adjacent to said second motor.

15. The lighting/signaling device according to claim 13, wherein said first motor and said second motor are mounted below said substantially horizontal optical axis.

* * * * *

UNITED STATES PATENT AND TRADEMARK OFFICE

CERTIFICATE OF CORRECTION

PATENT NO. : 7,452,116 B2
APPLICATION NO. : 11/114845
DATED : November 18, 2008
INVENTOR(S) : Natchoo It is certified that error appears in the above-identified patent and that said Letters Patent is hereby corrected as shown below:

Column 8
In claim 14, line 59, "device of according" should read --device according--.

Signed and Sealed this

Twentieth Day of January, 2009

JON W. DUDAS
*Director of the United States Patent and Trademark Office*